US007178279B2

(12) United States Patent
Molvidson et al.

(10) Patent No.: US 7,178,279 B2
(45) Date of Patent: Feb. 20, 2007

(54) DEVICE AND METHOD FOR SIGN ILLUMINATION

(75) Inventors: Robert Molvidson, Strandvägen (SE); Hartmuth Bodinger, Telegrafberget (SE)

(73) Assignee: Sign Safety i Sverige AB, Lidingö (SE)

( * ) Notice: Subject to any disclaimer, the term of this patent is extended or adjusted under 35 U.S.C. 154(b) by 130 days.

(21) Appl. No.: 10/514,921

(22) PCT Filed: May 16, 2003

(86) PCT No.: PCT/SE03/00797

§ 371 (c)(1),
(2), (4) Date: Nov. 15, 2004

(87) PCT Pub. No.: WO03/097942

PCT Pub. Date: Nov. 27, 2003

(65) Prior Publication Data

US 2005/0231121 A1 Oct. 20, 2005

(30) Foreign Application Priority Data

May 17, 2002 (SE) ..... 0201493
Jan. 21, 2003 (SE) ..... 0300132

(51) Int. Cl.
*G09F 13/00* (2006.01)

(52) U.S. Cl. ..... 40/444; 362/812

(58) Field of Classification Search ..... 362/812; 40/544, 442, 444

See application file for complete search history.

(56) References Cited

U.S. PATENT DOCUMENTS 4,090,464 A * 5/1978 Bishopp et al. ..... 116/63 R
5,122,939 A 6/1992 Kazdan et al.
5,276,424 A * 1/1994 Hegemann ..... 340/321
5,606,309 A * 2/1997 Smith ..... 340/473
6,092,318 A * 7/2000 Arie et al. ..... 40/547

(Continued)

FOREIGN PATENT DOCUMENTS

DE 29701729 U1 10/1997

(Continued)

OTHER PUBLICATIONS

International Search Report for PCT/SE03/00797.

(Continued)

*Primary Examiner*—Renee Luebke
*Assistant Examiner*—Julia A. Shallenberger
(74) *Attorney, Agent, or Firm*—Potomac Patent Group PLLC

(57) ABSTRACT

A device for illuminating an existing sign (100) having a specific given pattern on its front side, and a method of manufacturing such a device. A removable laminate (102) is intended to be applied to the front side of the sign, and comprises a mainly transparent cast compound or matrix (200) and a number of light emitting diodes (104) embedded in the matrix together with associated connected diode wires. The light emitting diodes are positioned in a specific pattern adapted to the existing pattern of the sign. Furthermore, a control unit (110) is configured to provide the light emitting diodes with electric current from a source of power supply (112) connected to the control unit, and to control the current feeding to the light emitting diodes in accordance with a predetermined scheme.

12 Claims, 2 Drawing Sheets

U.S. PATENT DOCUMENTS

| | | | | |
|---|---|---|---|---|
| 6,198,410 | B1 * | 3/2001 | White et al. | 340/907 |
| 6,448,905 | B1 * | 9/2002 | Jones | 340/907 |
| 6,771,021 | B2 * | 8/2004 | Cok | 313/512 |
| 2004/0128882 | A1 * | 7/2004 | Glass | 40/544 |

FOREIGN PATENT DOCUMENTS

| | | | |
|---|---|---|---|
| DE | 19811076 | A1 | 9/1999 |
| GB | 2347487 | A | 9/2000 |

OTHER PUBLICATIONS

International Preliminary Report on Patentability for PCT/SE03/00797.

* cited by examiner

DEVICE AND METHOD FOR SIGN ILLUMINATION

TECHNICAL FIELD

The present invention relates to a device and method for illumination of a sign.

BACKGROUND OF THE INVENTION

When displaying information or other things on a sign, some type of illumination or reflection is typically used in order to increase the visibility of the sign, particularly when visibility is reduced in the environment by darkness, fog or precipitation. One example of this is road signs having their front side covered with a light reflecting surface that increases the visibility of the road sign as it is illuminated by, e.g., a headlight. Some associated drawbacks are that a properly working headlight must be directed towards the sign, and that all normal existing road signs provide approximately the same degree of reflection, even though some signs may be more important to observe than others.

Signs may further be provided with one or more separate lamps illuminating the front of the sign at an angle from the side without obstructing the sign. Signs also exist having installed lamps illuminating the sign from within inside a light admitting shell made of plastics or glass. Such external or internal separate lamps are typically fed with electric current from a power supply network, and are relatively costly to install and maintain. Further, this type of sign illumination is fairly vulnerable to external damage.

A great need may exist for increasing the attention to certain signs. In the case of road signs, it is unfortunately common that road-users look at a sign in a routine fashion without observing its significance, which in the worst case may result in an accident. In particular, in areas where a relatively great number of subsequent signs frequently occur, the risk increases for signs more important than others with respect to road safety being overlooked. Road-users should be able in good time to catch sight of certain important road signs, e.g. at speed limits, pedestrian crossings, schools and at crossings where drivers must give way to traffic or must stop.

DE 29701729 U1 discloses a road sign provided with light emitting diodes integrated in the sign in a fixed pattern which are provided with electric current from a solar collector. Some drawbacks with this solution are that the sign must initially be built with the light emitting diodes installed, and that a relatively significant operation is required to repair or modify the illumination pattern afterwards.

In general, there is a great need for a relatively inexpensive and sturdy solution for providing existing signs with illumination of optional strength and pattern in a simple and flexible manner, e.g. in order to increase the attention therefor.

SUMMARY OF THE INVENTION

It is an object of the present invention to provide a solution to the above-mentioned problems. This object and others are obtained by a device for illuminating an existing sign having a specific given pattern on its front side, and a method of manufacturing such a device. A removable laminate is intended to be applied to the front side of the sign, and comprises a mainly transparent cast compound or matrix and a number of light emitting diodes embedded in the matrix together with associated connected diode wires, and positioned in a specific pattern adapted to the existing pattern of the sign. Furthermore, a control unit is configured to provide the light emitting diodes with electric current from a source of power supply connected to the control unit, and to turn on and off the light emitting diodes in accordance with a predetermined scheme.

The invention solves the problem of providing illumination to already existing signs which can be activated in an optional pattern and of optional strength and scheme, e.g. in order to increase the attention therefor. This solution does neither significantly affect the existing appearance and any visual effects of the signs, such as reflections.

BRIEF DESCRIPTION OF THE DRAWINGS

The invention is described in more detail by means of preferred exemplary embodiments with reference to the appended drawings.

DETAILED DESCRIPTION OF EMBODIMENTS

Figure 1:
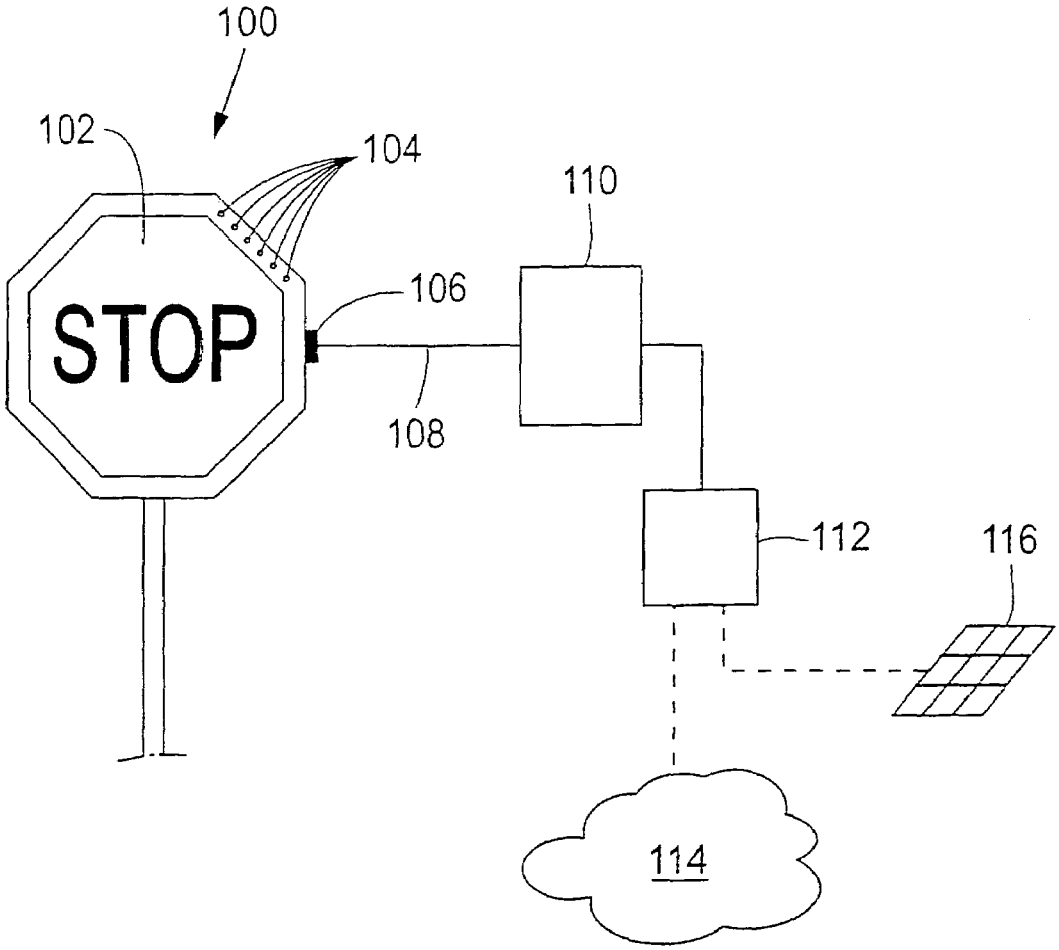
FIG. 1 is a schematic basic drawing of an illumination arrangement for a road sign.

In FIG. 1, a basic drawing is shown of an illumination arrangement for a sign 100 configured with a specific given pattern on its front side, in this case a stop sign. According to the present invention, the front side of the sign 100 is provided with a removable and basically transparent laminate 102 in which a number of light emitting diodes 104 are embedded and positioned in a specific pattern which is somehow adapted to the existing pattern and/or exterior outline of the sign. In the figure, only a few light emitting diodes are shown, although the number and positions of which of course can be selected as entirely free of choice within the scope of the invention, in order to obtain a desired lightning effect. The laminate 102 may be designed to completely or partly cover the front side of the sign 100, without obscuring the pattern of the sign, since the laminate is transparent. Thus, when the light emitting diodes are turned on, the visual appearance of the sign pattern can be intensified in order to catch the attention on this sign.

In this example, the light emitting diodes 104 in the laminate are coupled to a connection contact 106 arranged at an edge side of the laminate 102. The light emitting diodes 104 are connected to a control unit 110 by means of the connection contact 106 and a feeding line 108, the control unit 110 being configured to provide electric current to the light emitting diodes from a source of power supply 112 connected to the control unit. The power source may be, e.g., a battery, or a transformer connected to a power supply network 114, or an accumulator connected to a solar collector 116. This invention is not limited to any specific type of power source or power supply. However, in the case of road signs, it is advantageous to use a solar collector, since neither wire installation to a power supply network nor battery maintenance and replacements are then required.

Figure 2:
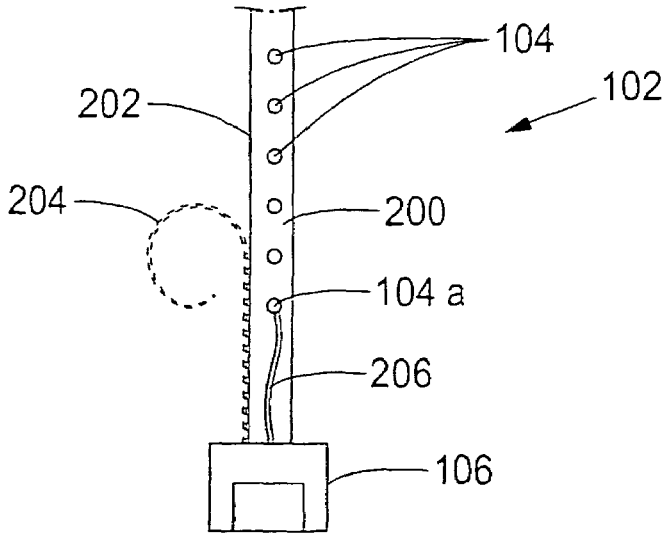
FIG. 2 is a detailed sectional view of a removable laminate having light emitting diodes, according to a preferred embodiment.

In FIG. 2, a section view is shown of a preferred embodiment of a laminate 102 in more detail, which is included in an illumination device as described above. The laminate 102 comprises a transparent cast compound or matrix 200 of a suitable material allowing that the light emitting diodes are embedded therein, e.g. PVC plastics. The rear side of the laminate to be attached to the front side of the sign, is preferably provided with a self-adhering adhesive layer 202 for this purpose. A peelable protective film 204 made of, e.g., a plastic or paper material, may preferably be applied on the adhesive layer 202 in order to facilitate handling of the laminate before being attached to the sign. The laminate may also be attached to the sign in other ways, e.g. by using pins or clamps, or by applying a liquid glue just before assembly. In such cases, the adhesive layer 202 and the protective film 204 can of course be omitted. However, it is advantageous if the attachment method allows for release of the laminate from the sign, e.g. for replacement, repair or modification.

As mentioned above, the light emitting diodes 104 are in this example connected to the control unit 110 by means of the connection contact 106. Thus, a wire 206 runs in the laminate from each light emitting diode, through which electric current can be fed to the diode. In FIG. 2, only one such diode wire 206 is shown for the sake of clarity, in this case running from a light emitting diode 104*a* to the connection contact 106. It should be noted that FIG. 1 illustrates the involved functional components only schematically. Within the scope of the invention, the control unit 110 and possibly also the power source 112 may in practice be arranged immediately adjacent to the laminate as a relatively small unit to which the wires 206 may be directly connected, without an intermediate contact 106 and feeding line 108. Alternatively, the control unit 110 and the power source may be mounted on the rear side of the sign, on a post carrying the sign, or at any other optional and suitable place.

The control unit 110 is configured to turn on and off the light emitting diodes according to a predetermined scheme. For this purpose, the control unit 110 comprises a processor, not shown, which can be programmed to establish connection and disconnection of the links between the diodes 104 and the power source 112, individually or by groups. It is also possible to configure the control unit such that the current fed to the diodes is varied in order to obtain a variable light intensity. The control unit 110, the feeding line 108 and the contact 106 may be provided with a plurality of current feeding channels to enable differentiated current feeding to the light emitting diodes.

Figure 3:
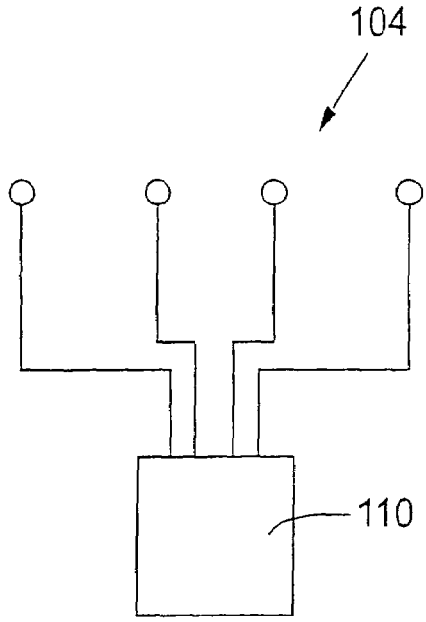
FIGS. 3, 4*a* and 4*b* illustrate schematically a few examples of how light emitting diodes can be connected to a power source.
Figure 4A:
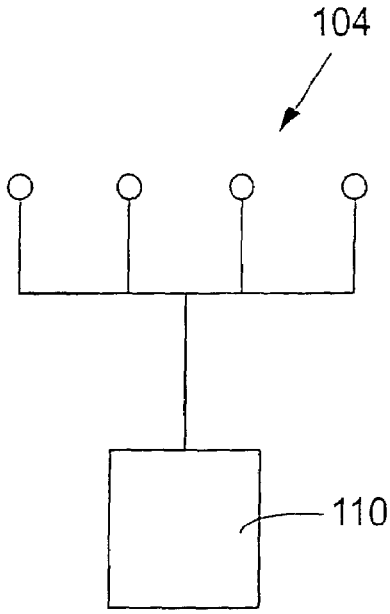
Figure 4B:
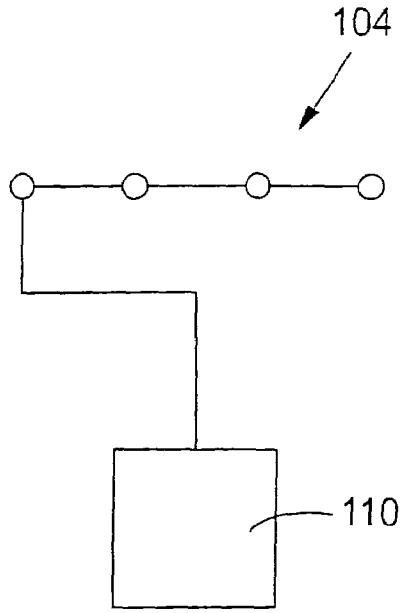

According to different embodiments, the light emitting diodes may be connected individually and/or by groups to the current feeding channels in the control unit 110 via the contact 106 and the feeding line 108. FIG. 3 illustrates that four light emitting diodes 104 are individually connected to the control unit 110, thereby enabling that each diode can be controlled independently of the other diodes by means of differentiated current feeding in the respective line. In FIGS. 4*a* and 4*b*, four diodes 104 are connected as a group to a common current feeding channel in the control unit 110, such that the four diodes are controlled uniformly. FIG. 4*a* shows a parallel connection and FIG. 4*b* shows a serial connection.

Within the scope of the invention, the laminate 102 may thus be configured with any optional connections of the included light emitting diodes 104 to current feeding channels, individually and/or in one or more groups, such that they can be controlled to shine according to a predetermined scheme, by means of suitable programming of the processor in the control unit 110. Selected light emitting diodes may in this way be turned on and off at certain points in time or at certain intervals. A simple example of such a scheme is that all diodes are turned on during the dark period of the day/night, or that the sign flashes or pulsates during rush hour, etc, which to some extent will provide energy savings. A "flowing" light can also be produced by means of suitable controlling of the light emitting diodes. Further, it is possible to create various decorative effects for other applications, such as advertising displays.

The present invention embraces also a method of manufacturing a device for illuminating an existing sign provided with a specific pattern. The manufacturing method includes casting a laminate 200, such that a plurality of light emitting diodes 104 together with associated connected wires 206 are embedded in a cast compound or matrix 200. During casting, the light emitting diodes 104 are positioned in a pattern that corresponds to the existing pattern of the sign. A self-adhering adhesive layer 202 may also be applied to the rear side of the laminate. However, this step may be omitted if another attachment method is selected.

The diode wires 206 are further connected to a control unit 110 and a source of power supply 112, as described above. The diode wires 206 are connected either directly to the control unit 110 or by means of a contact 106 on the laminate and a feeding line 108 if the control unit 110 is placed at a distance from the laminate. The laminate can then be attached to the existing sign in a position such that the diode pattern matches the existing pattern of the sign, and the control unit 110 can be activated to make the light emitting diodes shine according to a predetermined scheme which is programmed in the control unit. The steps of connecting the light emitting diodes to the control unit and of applying the laminate to the sign may of course be executed in any suitable sequence order.

The described embodiments do not limit the invention, which is generally defined by the following claims.

The invention claimed is:

1. A device for illuminating an existing sign having a specific given pattern on its front side, comprising:

a removable laminate intended to be applied to the front side of the sign, and comprising a mainly transparent cast compound or matrix and a number of light emitting diodes which are embedded in the matrix together with associated connected diode wires and positioned in a specific pattern adapted to the existing pattern of the sign, and a control unit configured to provide the light emitting diodes with electric current from a source of power supply connected to the control unit, and to control the current feeding to the light emitting diodes in accordance with a predetermined scheme.

2. A device according to claim 1, wherein the control unit comprises a processor which is programmable to execute said predetermined scheme.

3. A device according to claim 1 wherein the rear side of the laminate is provided with a self-adhering adhesive layer for attaching the laminate to the sign.

4. A device according to claim 1, wherein the diode wires can be directly connected to the control unit.

5. A device according to claim 1, wherein a connection contact is arranged at an edge side of the laminate, wherein the diode wires can be connected to the control unit by means of the connection contact and a feeding line.

6. A device according to claim 1, wherein the control unit comprises a plurality of current feeding channels, wherein the light emitting diodes can be connected individually and/or by groups to the current feeding channels in the control unit, such that selected light emitting diodes can be turned on and off at certain points in time or at certain intervals.

7. A method of manufacturing the device of claim 1, comprising the following steps;

casting a laminate comprising a cast compound or matrix and a plurality of light emitting diodes embedded in the matrix together with associated wires, such that the light emitting diodes are positioned in a specific pattern adapted to the existing pattern of the sign, connecting the diode wires to a control unit and a source of power supply, wherein the control unit is configured to control the current feeding to the light emitting diodes in accordance with a predetermined scheme, and applying the laminate to front side of the existing sign in a position such that the diode pattern matches the existing pattern of the sign.

8. A method according to claim 7, wherein the diode wires are directly connected to the control unit.

9. A method according to claim 7, further comprising the step of connecting the diode wires to the control unit by means of a contact on the laminate and a feeding line.

10. A method according to claim 7, further comprising the step of connecting the light emitting diodes individually and/or by groups to a plurality of current feeding channels in the control unit, such that selected light emitting diodes can be turned on and off at certain points in time or at certain intervals.

11. A method according to claim 7, further comprising the step of providing the rear side of the laminate with a self-adhering adhesive layer for attaching the laminate to the sign.

12. A device for illuminating a sign having a pattern of indicia on its front side, comprising:

a removable laminate adapted to be applied to the front side of the sign, said removable laminate comprising a substantially transparent material and a number of light emitting diodes which are embedded in the substantially transparent material together with associated, connected diode wires, and a control unit configured to provide the light emitting diodes with electric current from a power supply, and to control the current supplied to the light emitting diodes, wherein said removable laminate can be readily removed from said front of said sign and further wherein said control unit can selectively turn individual light emitting diodes off while other light emitting diodes remain turned on.

* * * * *